US005815784A

United States Patent [19]

Kasahara et al.

[11] Patent Number: 5,815,784

[45] Date of Patent: Sep. 29, 1998

[54] CLEANING DEVICE FOR AN IMAGE FORMING APPARATUS AND A TONER COLLECTING DEVICE THEREFOR

[75] Inventors: Nobuo Kasahara, Yokohama; Satoshi Muramatsu; Takashi Hodoshima, both of Kawasaki, all of Japan

[73] Assignee: Ricoh Company, Ltd., Tokyo, Japan

[21] Appl. No.: 748,979

[22] Filed: Nov. 14, 1996

[30] Foreign Application Priority Data

| | | | |
|---|---|---|---|
| Nov. 15, 1995 | [JP] | Japan | 7-297027 |
| Dec. 26, 1995 | [JP] | Japan | 7-339182 |
| Jun. 17, 1996 | [JP] | Japan | 8-155739 |
| Nov. 5, 1996 | [JP] | Japan | 8-292696 |

[51] Int. Cl.[6] ..... G03G 21/10

[52] U.S. Cl. ..... 399/358; 399/101; 399/359; 399/360

[58] Field of Search ..... 399/98, 99, 101, 399/343, 349, 355, 358, 359, 360

[56] References Cited

U.S. PATENT DOCUMENTS

| | | | |
|---|---|---|---|
| 4,627,716 | 12/1986 | Oka | 399/360 |
| 4,724,459 | 2/1988 | Ford | 399/359 X |
| 5,047,801 | 9/1991 | Haneda et al. | 399/358 X |
| 5,200,787 | 4/1993 | Nishiguchi | 399/359 |
| 5,250,997 | 10/1993 | Kaneko et al. | 399/99 |
| 5,272,510 | 12/1993 | Reese et al. | 399/358 |
| 5,526,100 | 6/1996 | Misago et al. | 399/358 X |

FOREIGN PATENT DOCUMENTS

| | | |
|---|---|---|
| 64-29663 | 1/1989 | Japan . |
| 1-293380 | 11/1989 | Japan . |
| 7-219329 | 8/1995 | Japan . |
| 7-219347 | 8/1995 | Japan . |

*Primary Examiner*—Sandra L. Brase
*Attorney, Agent, or Firm*—Oblon, Spivak, McClelland, Maier & Neustadt, P.C.

[57] ABSTRACT

In an image forming apparatus including a developing device storing a two-ingredient type or a one-ingredient type developer, a cleaning unit removes toner remaining on a photoconductive element after image formation. A toner conveying device conveys the toner collected by the cleaning unit to one or both of the developing unit and toner storing means. A powder pump includes a rotor and causes the rotor to rotate in order to move the collected toner in the axial direction of the rotor.

31 Claims, 15 Drawing Sheets

CLEANING DEVICE FOR AN IMAGE FORMING APPARATUS AND A TONER COLLECTING DEVICE THEREFOR

BACKGROUND OF THE INVENTION

The present invention relates to a printer, facsimile apparatus, copier or similar image forming apparatus including a developing device storing a two-ingredient type or a one-ingredient type developer.

An image forming apparatus has a cleaning device for removing and collecting toner remaining after image transfer. The toner collected by the cleaning device is conveyed to either a developing device or a toner storing section independent of the cleaning device. Some different schemes have been proposed for the conveyance of the collected toner. For example, a toner outlet portion included in the cleaning device may be connected to the toner storing section by a tubing accommodating a coil screw therein, as taught in, e.g., Japanese Utility Model Laid-Open Publication No. 94-29663. Alternatively, the toner storing section may be positioned in the vicinity of the toner outlet portion, so that the collected toner drops into the toner storing section due mainly to gravity.

Also, for the conveyance of a developer, toner or similar powder, various approaches are available. For example, a screw or a paddle or a bucket having a particular configuration may be used to convey such powder in a developing portion or a toner replenishing portion. Further, a screw pump generally referred to as a Mono pump may be used to replenish toner into the developing device, as disclosed in, e.g., Japanese Patent Laid-Open Publication No. 7-219329.

A toner conveying device conveys impurities including the toner collected by the cleaning device. Conveying means is built in the toner conveying device and has customarily been implemented as a tubing and a coil screw disposed therein. The tubing provides fluid communication between a toner outlet portion included in the cleaning device and toner storing means independent of the cleaning device. The coil screw conveys the collected toner. Another conventional conveying means causes the collected toner to drop due t o gravity.

The tubing and coil screw scheme suffer from various limitations, as follows. The coil screw must be extended to the vicinity of the toner storing means or the developing means. To insure the rotation of the coil screw, the path for conveying the collected toner must be configured as a linear path or a greatly curved path, i.e., an angular path is not usable. Further, the toner storing means should preferably be located below the toner outlet portion of the cleaning device. Besides, a heavy frictional load acts between the coil screw and the tubing and increases the torque necessary for rotating the coil screw. This makes it difficult to convey the collected toner over a long distance and renders a drive section bulky. As a result, it is difficult to simplify the apparatus, to insure durability, and to facilitate maintenance. Moreover, because the position for mounting the toner conveying device is limited, the apparatus becomes bulky and complicated and therefore increases in cost.

On the other hand, the gravity scheme is capable of conveying the toner relatively easily. However, the toner storing means or the developing means must be arranged substantially integrally with the cleaning device. Therefore, this kind of scheme is practicable only with low-speed image forming apparatuses or with copiers or printers designed for users who rarely use them, due to a limitation regarding mounting and limited toner storing capacity.

SUMMARY OF THE INVENTION

It is therefore an object of the present invention to provide an image forming apparatus capable of solving the above problems and surely conveying collected toner with a simple construction while insuring the quality and performance of cleaning means.

It is another object of the present invention to provide an image forming apparatus promoting the reuse of collected toner and thereby reducing the copy cost to a noticeable degree.

An image forming apparatus of the present invention includes a cleaning unit for removing toner remaining after image formation. A developing unit develops a latent image electrostatically formed on an image carrier to thereby produce a corresponding toner image. A toner storing section stores the toner collected by the cleaning unit. A toner conveying device conveys the toner collected by the cleaning unit to at least one of the developing unit and toner storing section. A screw pump is included in the toner conveying device for rotating a rotor to thereby move the toner collected by the cleaning means in the axial direction of the rotor.

BRIEF DESCRIPTION OF THE DRAWINGS

The above and other objects, features and advantages of the present invention will become apparent from the following detailed description taken with the accompanying drawings in which.

In the figures, identical reference numerals designate identical structural elements.

DESCRIPTION OF THE PREFERRED EMBODIMENTS

Figure 1:
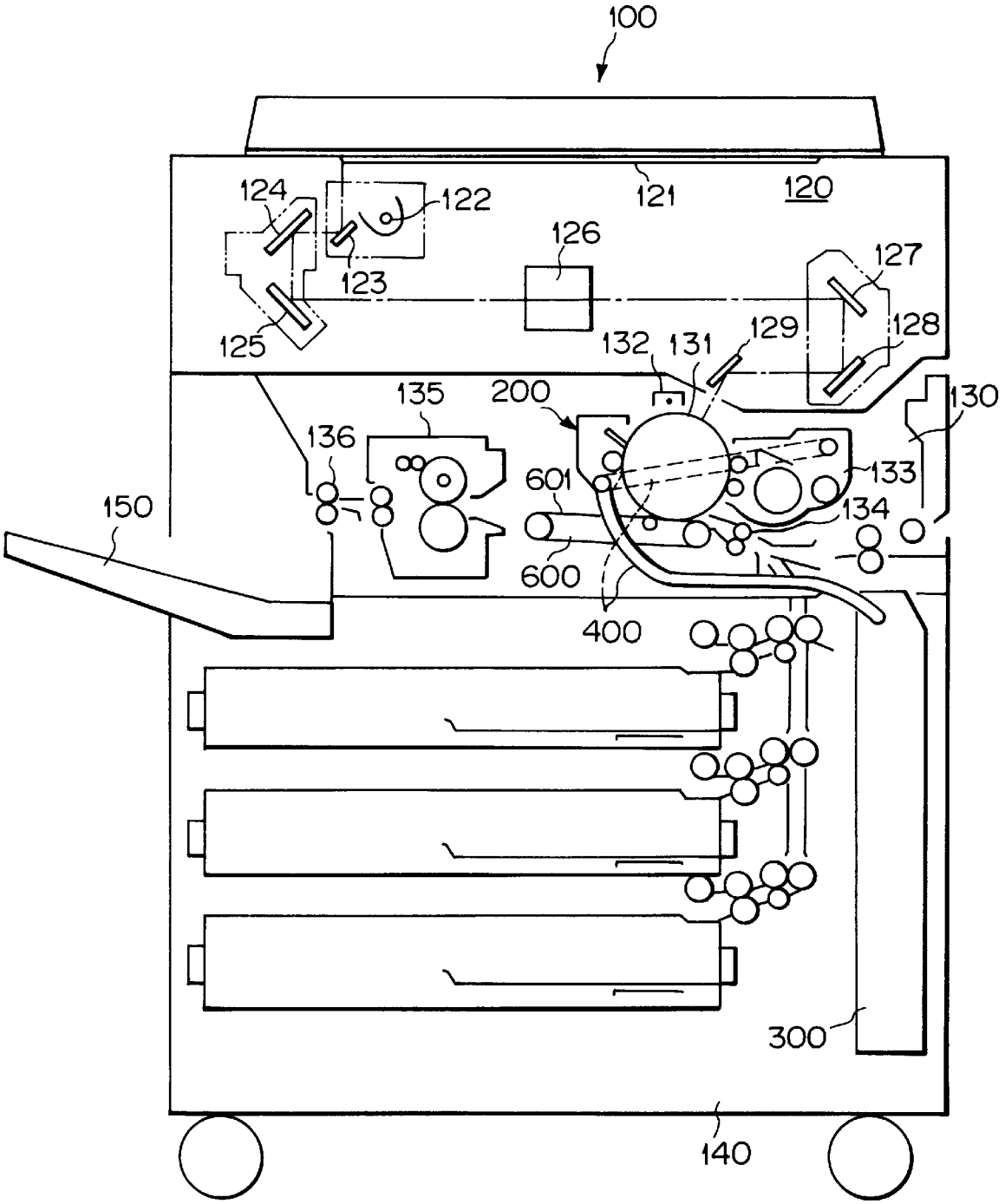
FIG. 1 is a side elevation showing an image forming apparatus embodying the present invention.

Referring to FIG. 1 of the drawings, an image forming apparatus incorporating a first embodiment of the present invention is shown and implemented as an electrophotographic copier by way of example. As shown, the copier, generally 100, is generally made up of an exposing section 120, an image forming section 130, and a sheet feeding section 140.

The exposing section 120 includes a glass platen 121. A light source 122 illuminates a document laid on the glass platen 121. The resulting reflection from the document is incident to a photoconductive drum 131 via optics including mirrors 123, 124, 125, 127, 128 and 129 and a lens 126. The image forming section 130 includes, in addition to the drum 131, a charging unit 132, a developing unit or developing means 133, a registration roller 134, a transfer belt unit 600, a cleaning unit or cleaning means 200, and a fixing unit 135 which are arranged around the drum 131. The sheet feeding section 140 includes a plurality of cassettes each being loaded with a stack of sheets of particular size. The exposing section 120 may be implemented by laser scanning optics including a laser and a deflector, in which case the copier 100 will turn out a laser printer. Further, the copier 100 may be provided with a document reading device so as to turn out a digital copier or a facsimile apparatus.

In operation, the charging unit 132 charges the surface of the drum 131 uniformly. The exposing section 120 exposes the charged surface of the drum 131 with a document image and thereby electrostatically forms a corresponding latent image. The developing unit 133 develops the latent image with a developer (either two-ingredient type or one-ingredient type) to thereby form a corresponding toner image. The toner image is transferred from the drum 131 to a sheet fed from the sheet feeding section 140 to an image transfer position via the registration roller 134. The image transfer position is defined by a nip between the drum 131 and a transfer belt 601 included in the transfer belt unit 600. The belt 601 conveys the sheet to the fixing unit 135. The fixing unit 135 fixes the toner image on the sheet. Subsequently, the sheet with the toner image is driven out to a tray 150 via a discharge roller 136. After the image transfer, the cleaning unit 200 removes the toner, paper dust and other impurities remaining on the drum 131.

In the illustrative embodiment, the toner removed from the drum 131 by the cleaning unit 200 is selectively collected in a tank or storing means 300 or conveyed to the developing unit 133. The tank 300 is implemented as an independent unit removable from the copier body 100. To convey the toner to the tank 300 or the developing unit 133, a toner conveying device to be described is provided.

Figure 2:
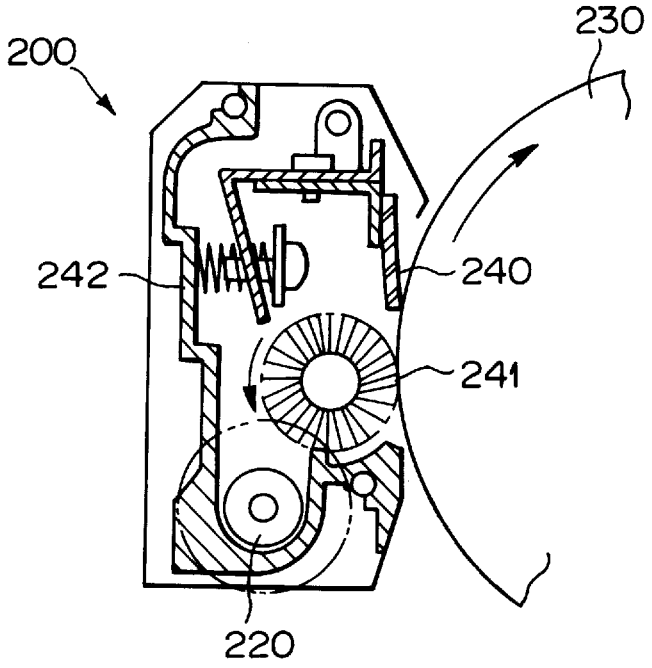
FIG. 2 is a section showing a specific configuration of cleaning means included in the embodiment.
Figure 3:
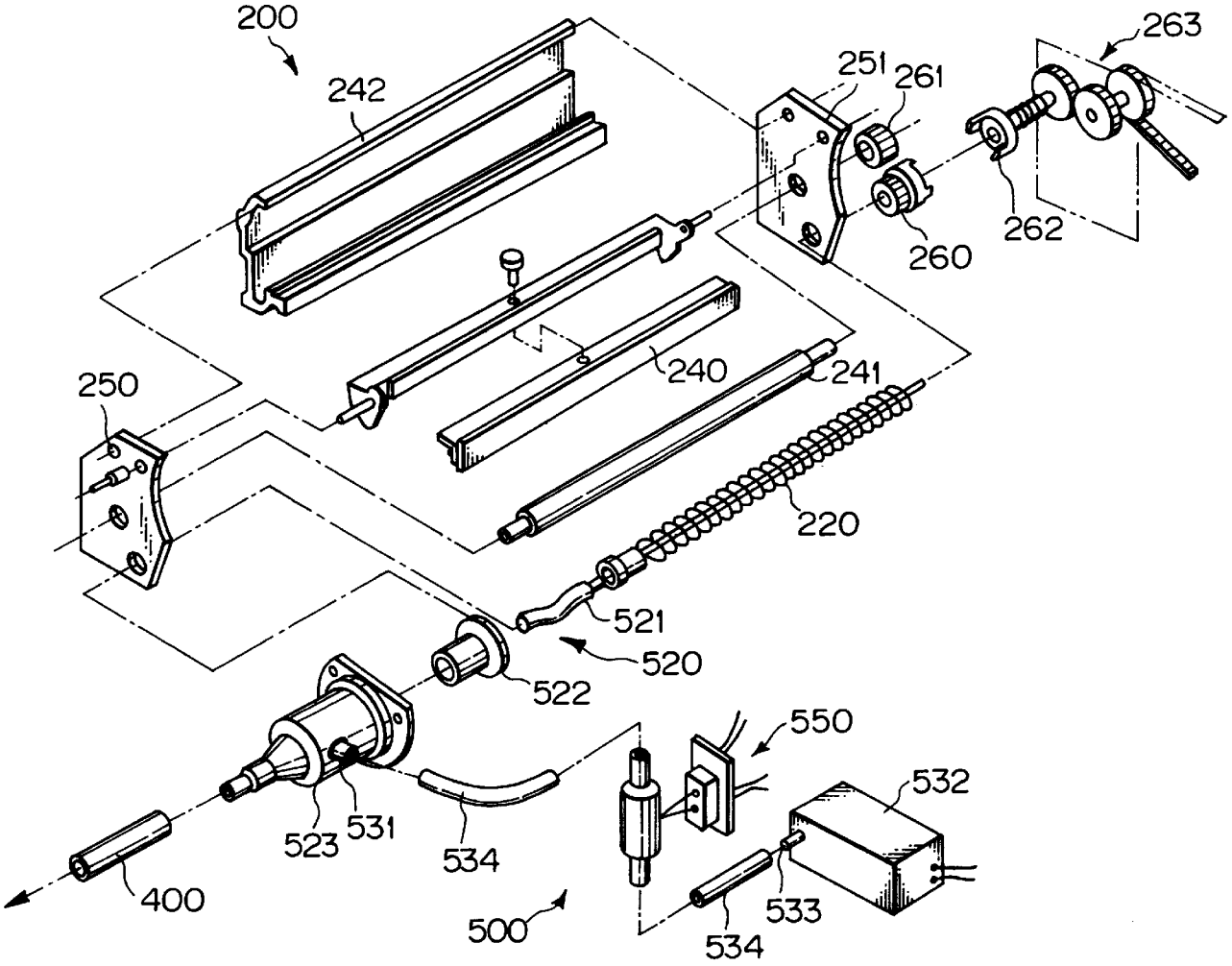
FIG. 3 is a perspective view of the cleaning means shown in FIG. 2.

As shown in FIGS. 2 and 3, the toner conveying device has a toner discharging member or toner moving means 220, a toner conveying unit 500, and a pipe or toner guiding means 400. The toner discharging member 220 is disposed in the cleaning unit 200. The toner conveying unit 500 has a powder pump or screw pump means 520 and an air pump or air feeding means 532.

The cleaning unit 200 uses a cleaning blade 240 and a brush 241 to clean the drum 131. The toner remaining on the drum 131 is scraped off by the blade 240 and brush 241. The removed toner is collected in a casing 242 which bifunctions as the structural body of the unit 200 and a toner guiding member. The toner discharging member 220 is located at the bottom of the casing 242 and conveys the collected toner to the powder pump 520.

As shown in FIG. 3, a main motor, not shown, mounted on the copier body 100 drives a drive gear 260 via a drive member 263 and a joint gear 262. The toner discharging member 220 is journalled to a front and a rear side wall 250 and 251 included in the casing 242. The drive gear 260 is held in mesh with the discharging member 220. The brush 241 is also journalled to the side walls 250 and 251. A brush drive gear 261 is held in mesh with the drive gear 260 and the brush 241.

Figure 4:
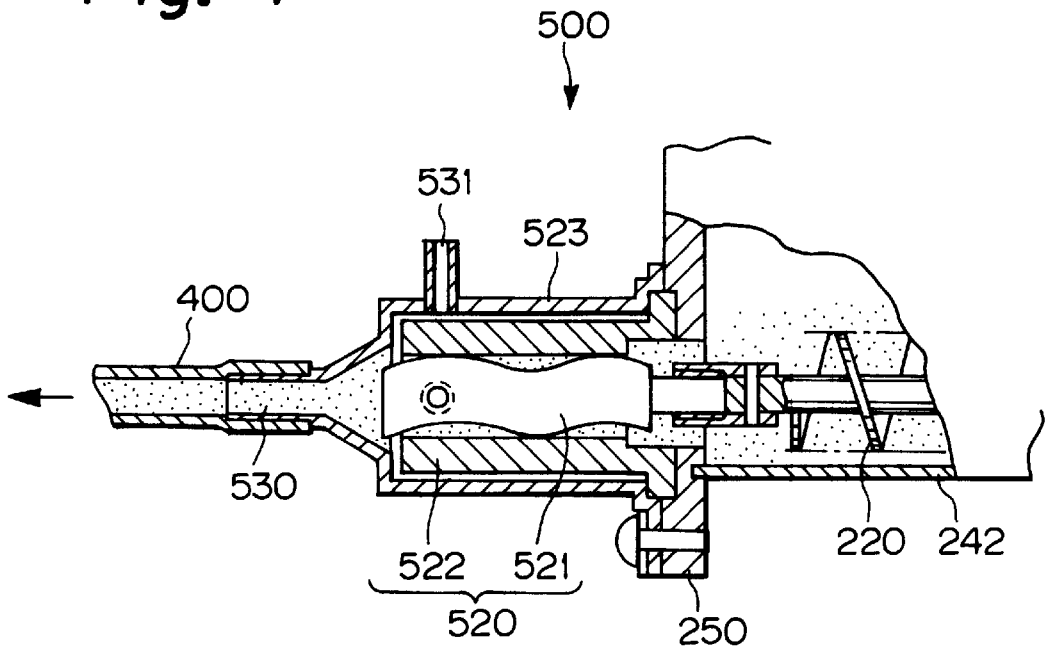
FIG. 4 is a section showing a powder pump unit built in a cleaning device included in the embodiment.

As shown in FIG. 4, the powder pump 500 is implemented as a conventional screw pump generally referred to as a Mono pump. Specifically, the pump 520 has a rotor 521 formed of, e.g., metal, and a stator 522 surrounding the rotor 521 and formed of rubber or similar elastic material. The stator 522 is held by a holder 523. The rotor 521 is connected to the shaft of the toner discharging member 220 and driven by the main motor via the above gearing.

The outer periphery of the stator 522 and the inner periphery of the holder 523 are spaced by a gap of about 1 mm. The gap is communicated to a toner passage 530. An air inlet port 531 is communicated to the above gap in order to feed air under pressure to the toner passage 530. As shown in FIG. 3, the air inlet port 531 is communicated by a tubing 534 to an air outlet port 533 formed in the air pump 532 and an air sensor or sensing means 550.

The air pump 532 feeds air under pressure to the collected toner via the air inlet port 531 at a rate of about 0.5 liter to 1 liter per minute. The air serves to enhance the fluidity of the collected toner being driven out via the toner passage 530. This allows the pump 530 to convey the toner more positively.

The toner coming out of the pump 520 is conveyed to the tank 300 by a tubing 400 indicated by a solid line in FIG. 1 or conveyed to the developing device 133 by a tubing 400 indicated by a phantom line in FIG. 1. The tubing 400 should preferably be formed of soft vinyl chloride, Nylon, Teflon or similar flexible material highly resistive to the toner.

The tubing 400 may be implemented as a single tube or made up of a plurality of tubes connected together. This is also true with the tubing 534 extending from the air pump 532. This kind of scheme facilitates the unit configuration of the device and enhances the productivity and easy maintenance of the device. If desired, the tubing 400 may be bifurcated in order to deliver the collected toner to both the tank 300 and the developing device 133.

The distance over which the toner is conveyed can be freely selected by selecting the sizes of the rotor 521 and stator 522 of the powder pump 520 as well as the rotation speed of the rotor 521. Also, the direction in which the toner is conveyed is open to choice. Usually, the toner may be conveyed at a rate of 5 grams to 20 grams per minute over the maximum distance of about 2 meters.

The toner conveying unit 500 may be so controlled as to start operating substantially at the same time as the cleaning unit 200. However, in the illustrative embodiment, the air pump 532 starts operating, e.g., 0.5 second to 1 second before the cleaning unit 200. Further, after the cleaning unit 200 has stopped operating, only the air pump 532 continuously operates for, e.g., 1 second to 3 seconds. This kind of control is advantageous in the following respect.

While the powder pump 520 is in operation, the toner substantially evenly mixed with air fills substantially the entire range of the tubing 400. Assume that the powder pump 520 and air pump 532 stop operating at the same time. Then, air is released from the toner and air mixture filling the tubing 400, causing the toner to fall due to its own weight. As a result, the bulk density of the toner increases in the tubing 400. When the toner is conveyed later in order to resume the operation of the cleaning unit 200, it is blocked by the toner remaining in the tubing 400 and having the high bulk density. As a result, the toner stops up the tubing 400. This causes the powder pump 520 to lock or to stick, i.e., cause the toner to adhere to the rotor 521 due to excessive temperature elevation. This part of the toner shaves the stator 522 and damages the pump 520.

By contrast, if the air pump 532 starts operating before the cleaning unit 200, the toner remaining in the tubing 400 and having the high bulk density can be driven out only by compressed air. Also, if the air pump 532 continuously operates for a preselected period of time after the stop of operation of the cleaning unit 200, the toner remaining in the tubing 400 can be driven out. As a result, the tubing 400 is substantially entirely evacuated. This successfully prevents the tubing 400 from being stopped up by the toner and thereby further enhances the sure conveyance of the toner.

Figure 5:
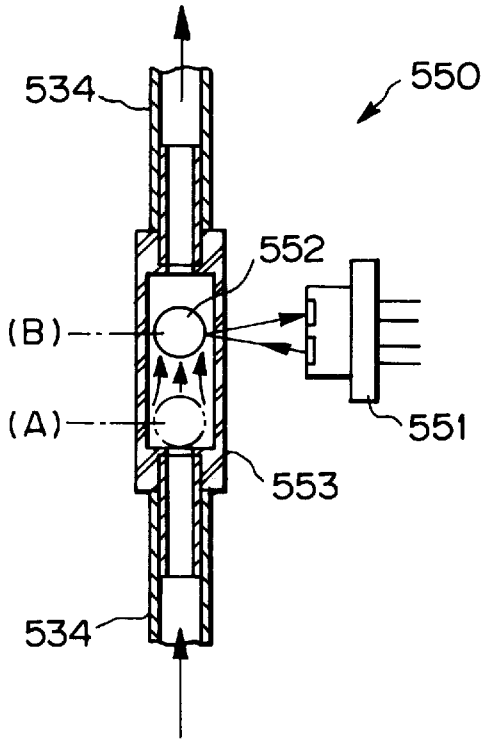
FIG. 5 is a section showing an air sensor mounted on the powder pump unit.

FIG. 5 shows a specific configuration of the air sensor 550. The prerequisite with the toner conveying device using the powder pump 520 is that the collected toner be surely conveyed together with air. The air sensor 550 determines whether or not compressed air is being fed from the air pump 532 to the powder pump 520. In this sense, the air sensor 550 plays the role of a safety implementation for minimizing the system down of the cleaning unit 200. As shown in FIG. 5, the air sensor 550 has a transparent receptacle 553, tubes 534 connected to opposite ends of the container 553, and a float 552 disposed in the receptacle 553. When the air pump 532 starts operating and feeds air under pressure in a direction indicated by an arrow in FIG. 5, the float 552 is raised by the air from a position (A) to a position (B). A sensor 551 has a light emitting element and a light-sensitive element and is located to face the above position (B). The output of the sensor 551 responsive to the float 552 is sent to a controller, not shown, included in the copier body 100. Specifically, if the output of the sensor 551 shows that the float 552 is present, the controller determines that compressed air is being fed to the powder pump 520. If the output of the sensor 551 shows that the float 552 is absent, the controller determines that some error has occurred in the supply of compressed air. Then, the controller stops the operation of the cleaning device 200, displays the error on a display mounted on the copier body 100, and stops the image forming operation of the copier body 100.

While the float 552 is assumed to be a ball formed of resin or stainless steel or similar metal, it may, of course, b e provided with any other suitable configuration and formed of any other suitable material. While the sensor 551 is implemented as a reflection type sensor, it may, of course, be of transmission type or of magnetic type.

Figure 6:
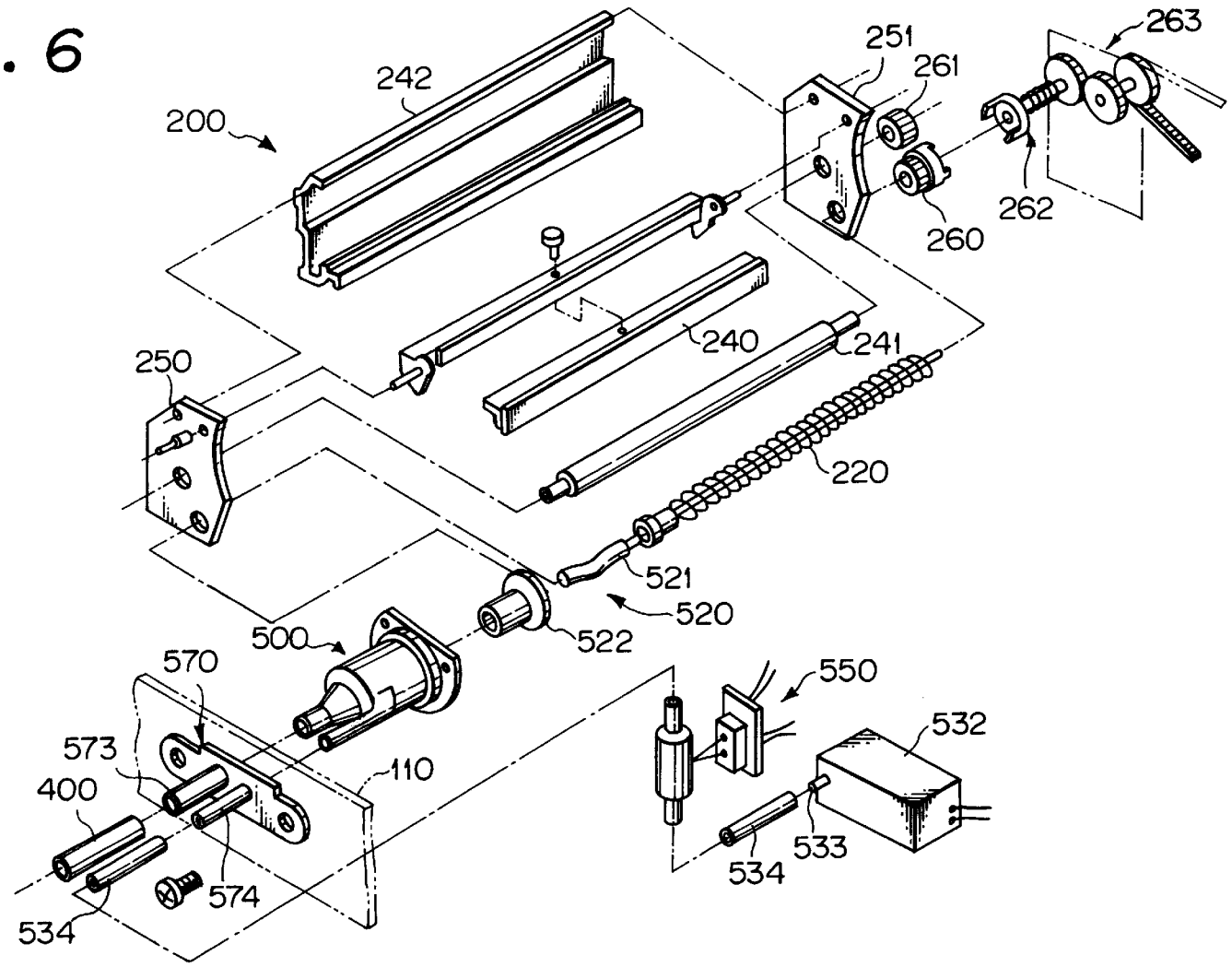
FIG. 6 is an exploded perspective view showing another specific configuration of the cleaning means.

Another specific configuration of the cleaning means will be described with reference to FIG. 6. As shown, the air pump 532 causes the collected toner to flow from the cleaning unit 200 to the tank 300 or the developing unit 133 in a dispersed condition. The tubing 400 delivers the collected toner from the cleaning unit 200 to one or both of the tank 300 and developing unit 133. The air pump 532 and tubing 400 are separably connected and communicated to each other by a holder 570.

Figure 7:
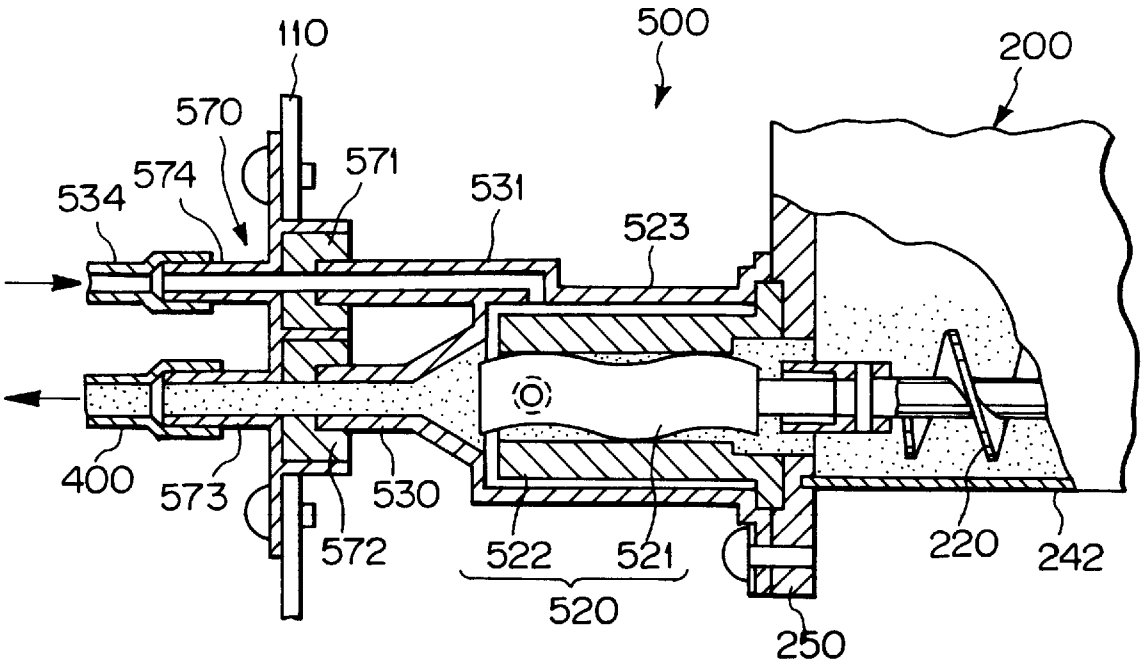
FIG. 7 is a section showing the powder pump unit.

The holder 570 is affixed to a side wall 110 included in the copier body 100. A toner outlet portion 573 and an air inlet portion 574 are provided on the outer surface of the holder 570, as illustrated. The toner outlet portion 573 is connected to the tubing 534 extending from the air pump 532 while the air inlet portion 574 is connected to the tubing 400. As shown in FIG. 7, seal members 571 and 572 are provided on the inner surface of the holder 570. The seal members 571 and 572 are removably engaged with the air inlet port 531 and toner passage 530 of the powder pump 520 in order to prevent compressed air and toner from leaking. The seal members 571 and 572 are formed of, e.g., sponge rubber.

With the above alternative configuration, the cleaning unit 200 is bodily removable from the copier body 100. Specifically, it is possible to separate the cleaning unit 200 from the tubings 400 and 534 via the holder 570 and to fix the tubings 400 and 534 to the copier body 100.

Figure 8:
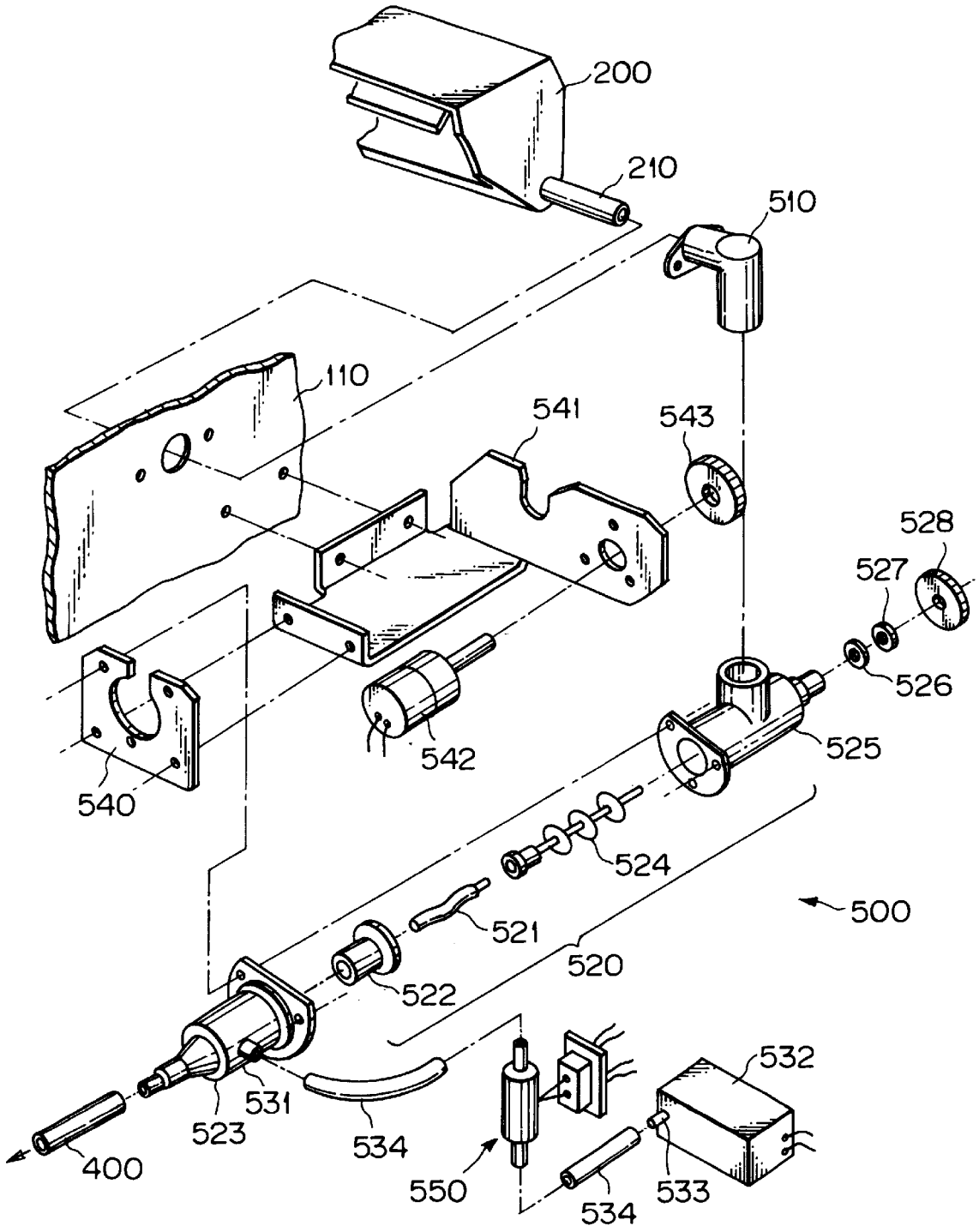
FIG. 8 is an exploded perspective view showing still another specific configuration of the cleaning means.
Figure 9:
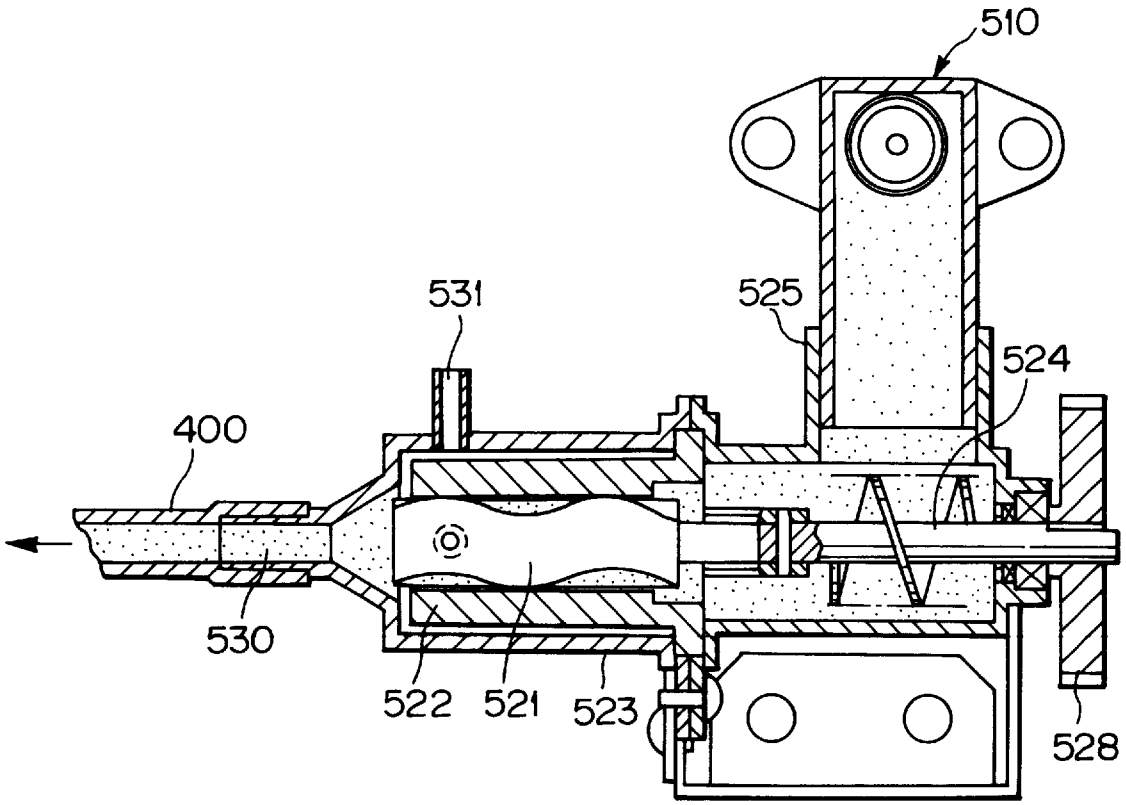
FIG. 9 is a section showing a toner conveying unit included in the embodiment.
Figure 10:
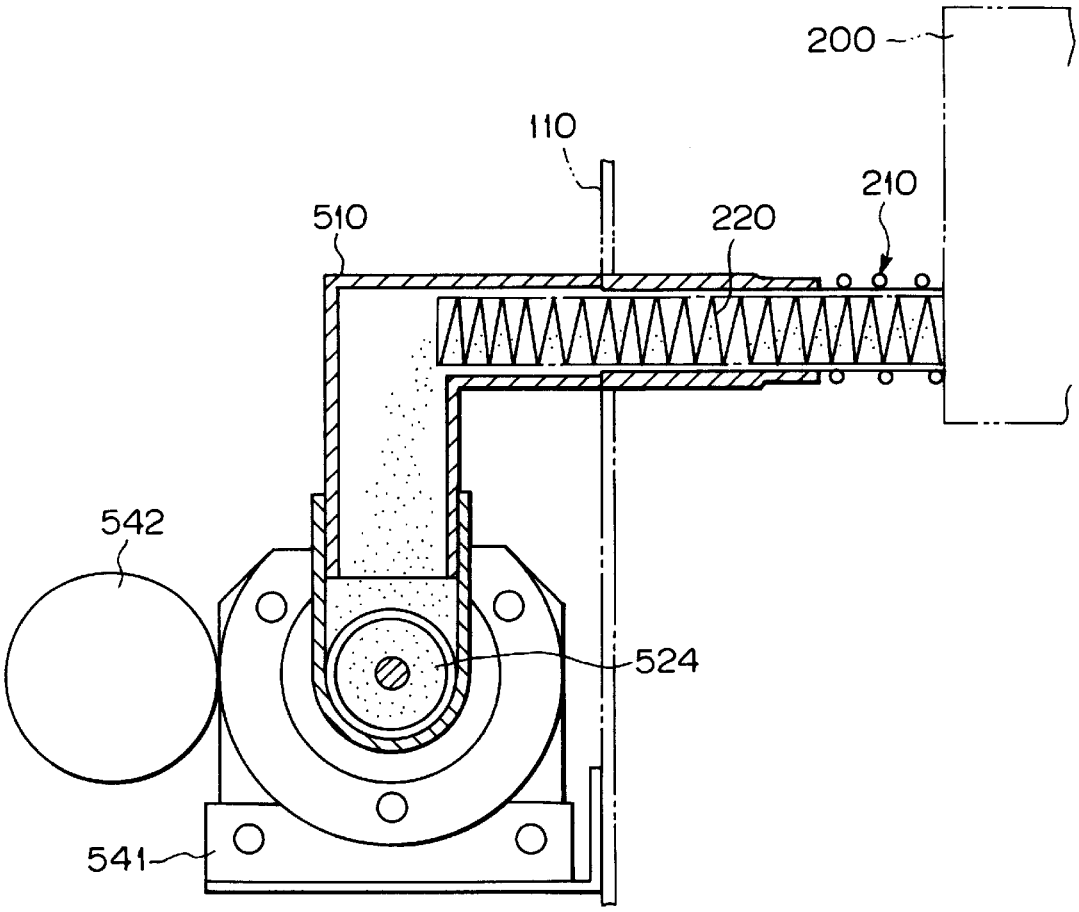
FIG. 10 is a fragmentary section showing the toner conveying unit.
Figure 11:
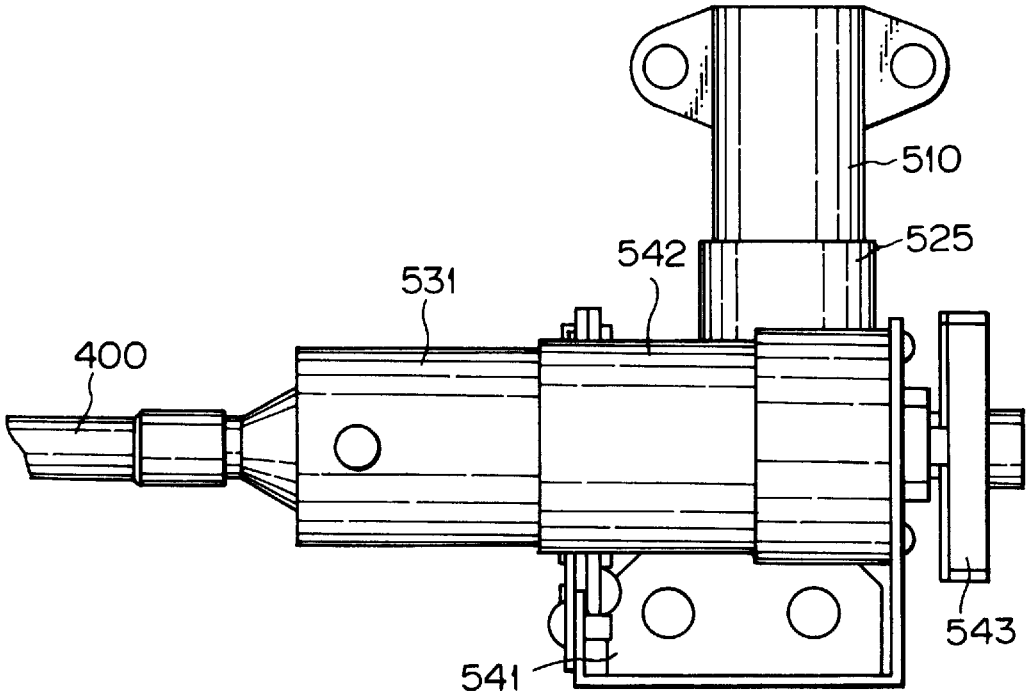
FIG. 11 is a front view showing the toner conveying unit.
Figure 12:
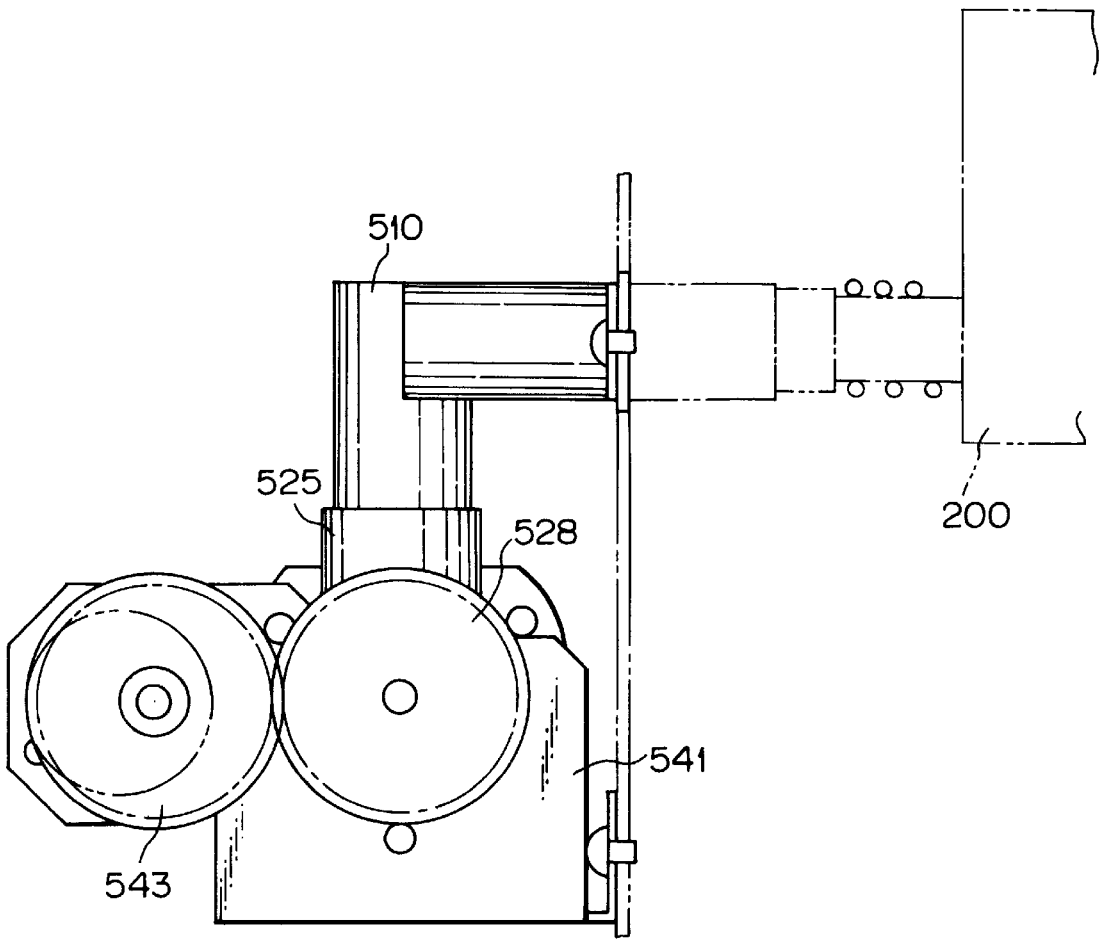
FIG. 12 is a side elevation showing the toner conveying unit.

FIGS. 8 and 9 show still another specific configuration of the cleaning means. As shown, the cleaning unit 200 includes a toner outlet portion 210 while the toner conveying unit 500 includes a toner receiving member 510 engaged with the toner outlet portion 210. The toner collected by the cleaning unit 200 is transferred to the toner receiving member 510 via the toner outlet portion 210. The cleaning unit 200, drum 131, developing unit 133, toner conveying unit 500 and other image forming members are mounted on a side wall 110 included in the copier body 100. The toner conveying unit 500 is separate from the cleaning unit 200, as illustrated.

Again, the powder pump 520 is implemented as a screw pump or Mono pump. The rotor 521 of the pump 520 is engaged with one end of a screw 524 for conveyance. The other end of the screw 524 is engaged with a seal member 526, a bearing 527, and a driven gear 528. A hopper 525 is engaged with the toner receiving member 510. As shown in FIGS. 8–12, the pump 520 is mounted on a support member 541 by a mounting member 540. A drive motor 542 is also mounted on the support member 541. A drive gear 543 is mounted on the output shaft of the motor 542 and held in mesh with the driven gear 528.

The holder 523 has the air inlet port 531 communicated to the air pump 532. The air outlet port 533 of the air pump 532 is communicated to the air inlet port 531 via the air sensor 550 and tubes 534 shown in FIG. 5. The toner passed through the pump 520 is delivered to the tank 300 or the developing unit 133 via the flexible tubing 400.

The toner discharging member 220 is disposed in the toner outlet portion 210 and implemented as, e.g., a coil screw. The screw 220 conveys the collected toner from the cleaning unit 200 to the toner conveying unit 500. As shown in FIGS. 8–12, the pump 520 is driven by the exclusive motor 542. Alternatively, the pump 520 may be driven by a drive system built in the copier body 100 in order to further reduce the size and cost of the device and to simplify the construction.

Figure 13:
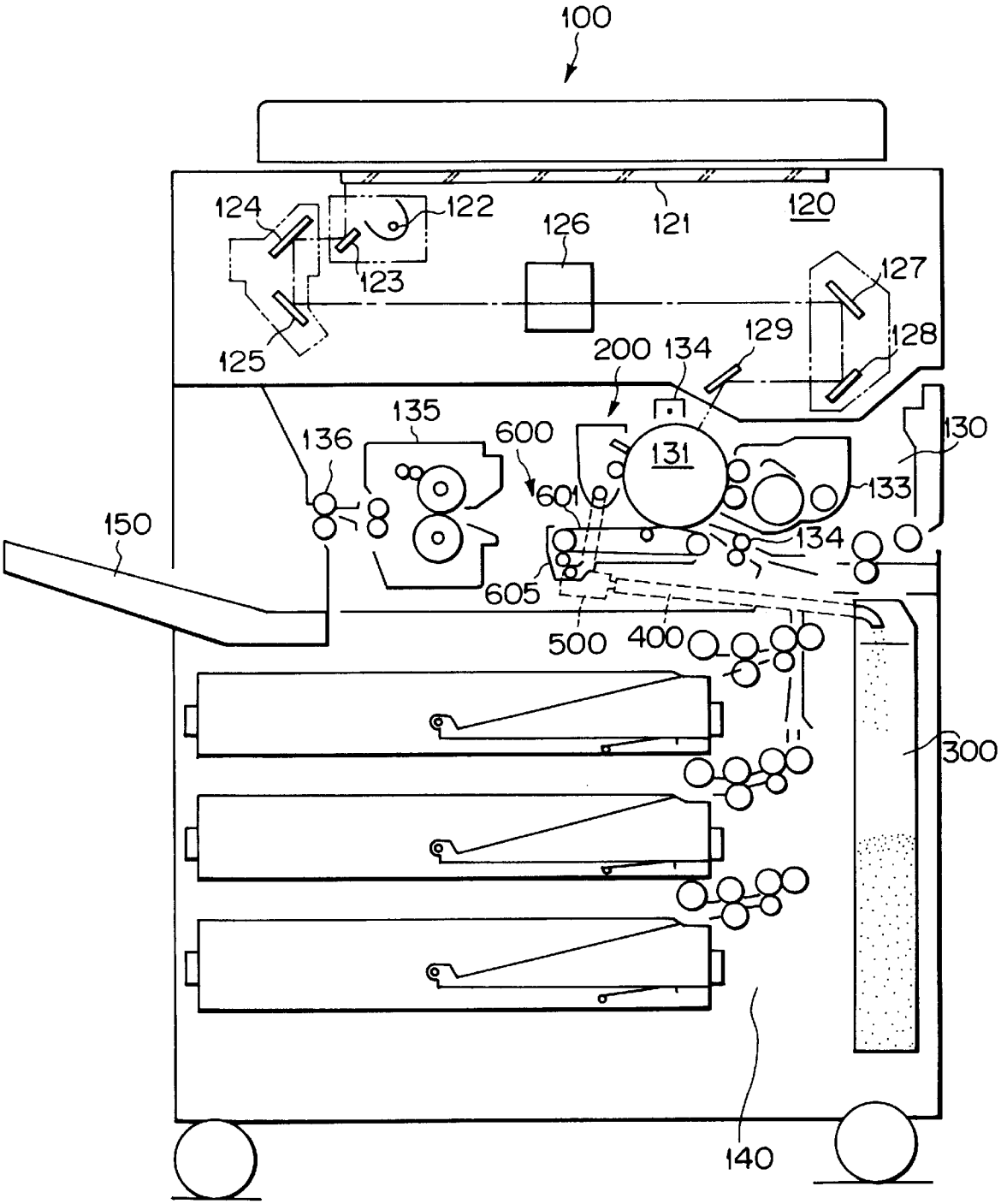
FIG. 13 is a side elevation showing an alternative embodiment of the present invention.

Referring to FIG. 13, an alternative embodiment of the present invention will be described. As shown, the copier body includes, in addition to the cleaning unit 200, cleaning means 605 disposed in the transfer belt unit 600. The tubing 400 connects the cleaning unit 200, cleaning means 605 and tank 300 via the toner conveying unit 500.

Figure 14:
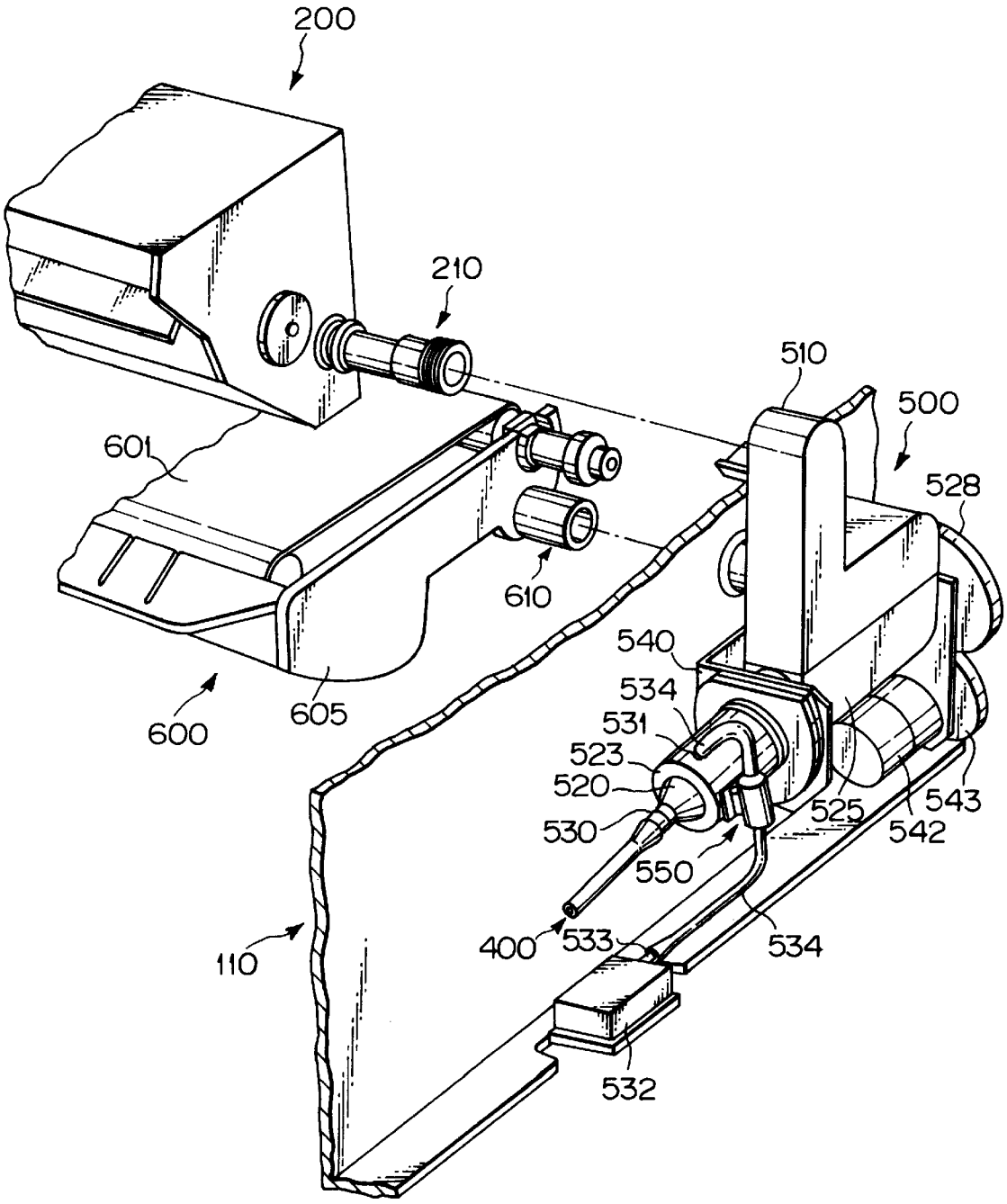
FIG. 14 is a fragmentary perspective view showing a toner conveying unit included in the alternative embodiment.

As shown in FIG. 14, the toner collected by the cleaning unit 200 is transferred from the toner outlet portion 210 of the cleaning unit 200 to the toner guiding member 510 of the toner conveying unit 500. The toner guiding member 510 forms a passage for delivering the toner from the cleaning unit 200 to the powder pump 520. Likewise, the toner collected by the cleaning means 605 is delivered to the toner guiding member 510 via a toner outlet portion 610 forming part of the transfer belt unit 600. The cleaning unit 200, transfer belt unit 600, drum 131, developing unit 133 and other image forming members as well as the toner conveying unit 500 are mounted on the side wall 110 of the copier body 100.

Figure 15:
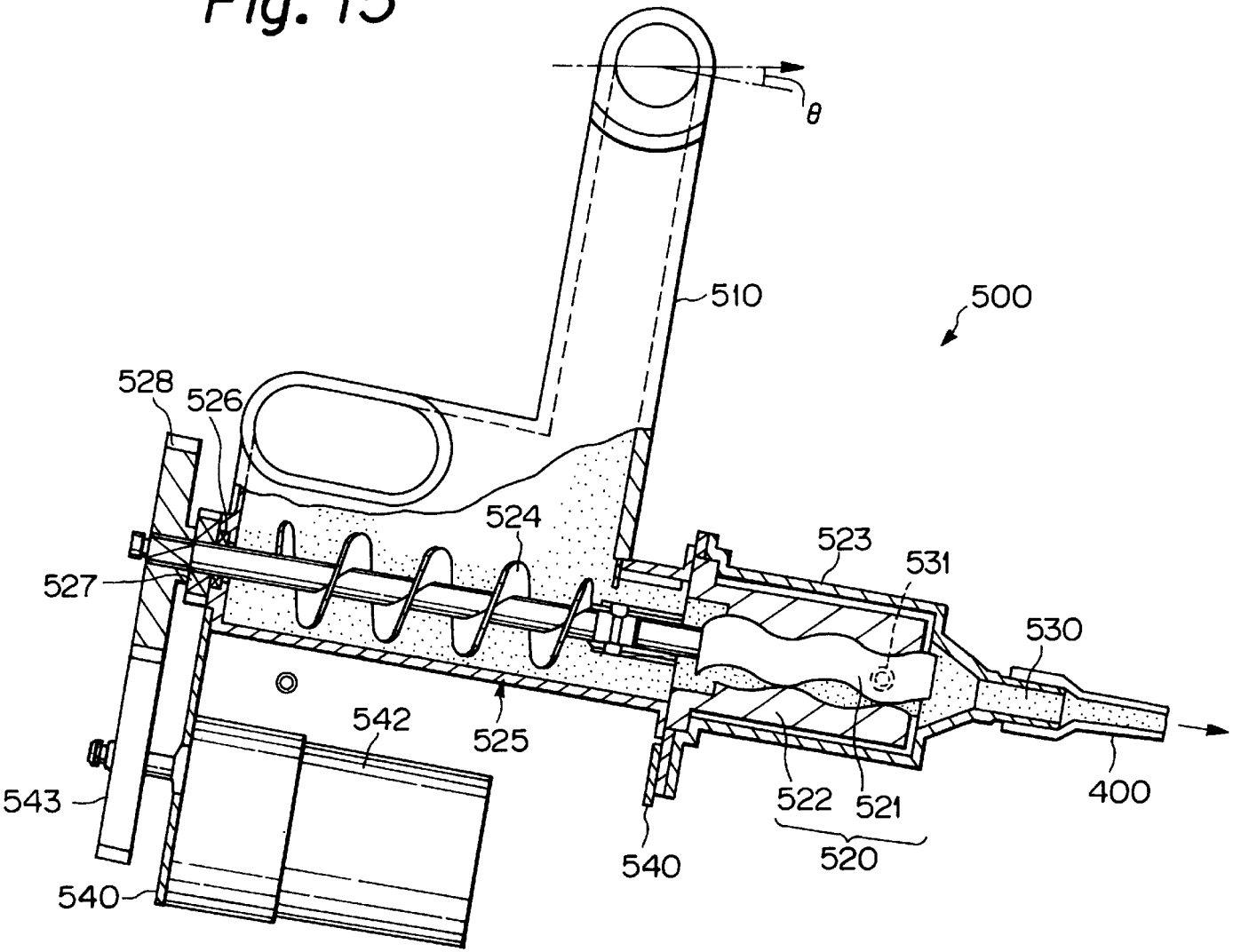
FIG. 15 is a fragmentary section showing the toner conveying unit shown in FIG. 14.

As shown in FIG. 15, the rotor 521 of the powder pump or Mono pump 520 is coaxially connected to one end of the screw 524. The other end of the screw 524 is supported via the seal member 526 by the bearing 527 affixed to the support member 547 and is held in mesh with the driven gear 528. The hopper 525 accommodating the screw 524 is engaged with the toner guide member 510 supported by the support member 540, constituting toner conveying means for conveying the toner to the pump 520. The pump 520 is mounted on the support member 540 via the holder 523 and connected to the hopper 525. The motor 542 is also mounted on the support member 540. The driven gear 543 is mounted on the output shaft of the motor 542 and held in mesh with the driven gear 528. While the motor 542 is in rotation, it rotates the screw 524 and rotor 521 via the drive gear 543 and driven gear 528. As a result, the screw 524 delivers to the pump 520 the toner being introduced into the hopper 525 via the toner guiding member 510. The air inlet port 531 of the pump 520 is communicated to the air outlet port 533 of the air pump 532 and the air sensor 550 by the tubes 534.

As shown in FIG. 15, the toner conveying unit 500 is inclined by an angle 0 of about 10 degrees toward the powder pump 520 with respect to the horizontal direction. Such an inclination allows gravity to act on the conveyance of the toner in the hopper 525 for a unit time in addition to the function of the screw 524. This kind of configuration is advantageous when the device is applied to a high-speed machine or when it is desired to miniaturize the pump 520.

Again, the toner conveying unit 500 may be so controlled as to start operating substantially at the same time as the cleaning unit 200 and cleaning means 605 of the apparatus body. However, in the illustrative embodiment, the air pump 532 starts operating before the cleaning unit 200 and cleaning means 605, as in the previous embodiment. Further, after the cleaning unit 200 and cleaning means 605 have stopped operating, only the air pump 532 continuously operates for a preselected period of time. In this condition, the toner remaining in the tubing 400 and having the high bulk density can be driven out only by compressed air. This successfully prevents the tubing 400 from being stopped up by the toner and thereby further enhances the sure conveyance of the toner, as stated earlier.

Figure 16:
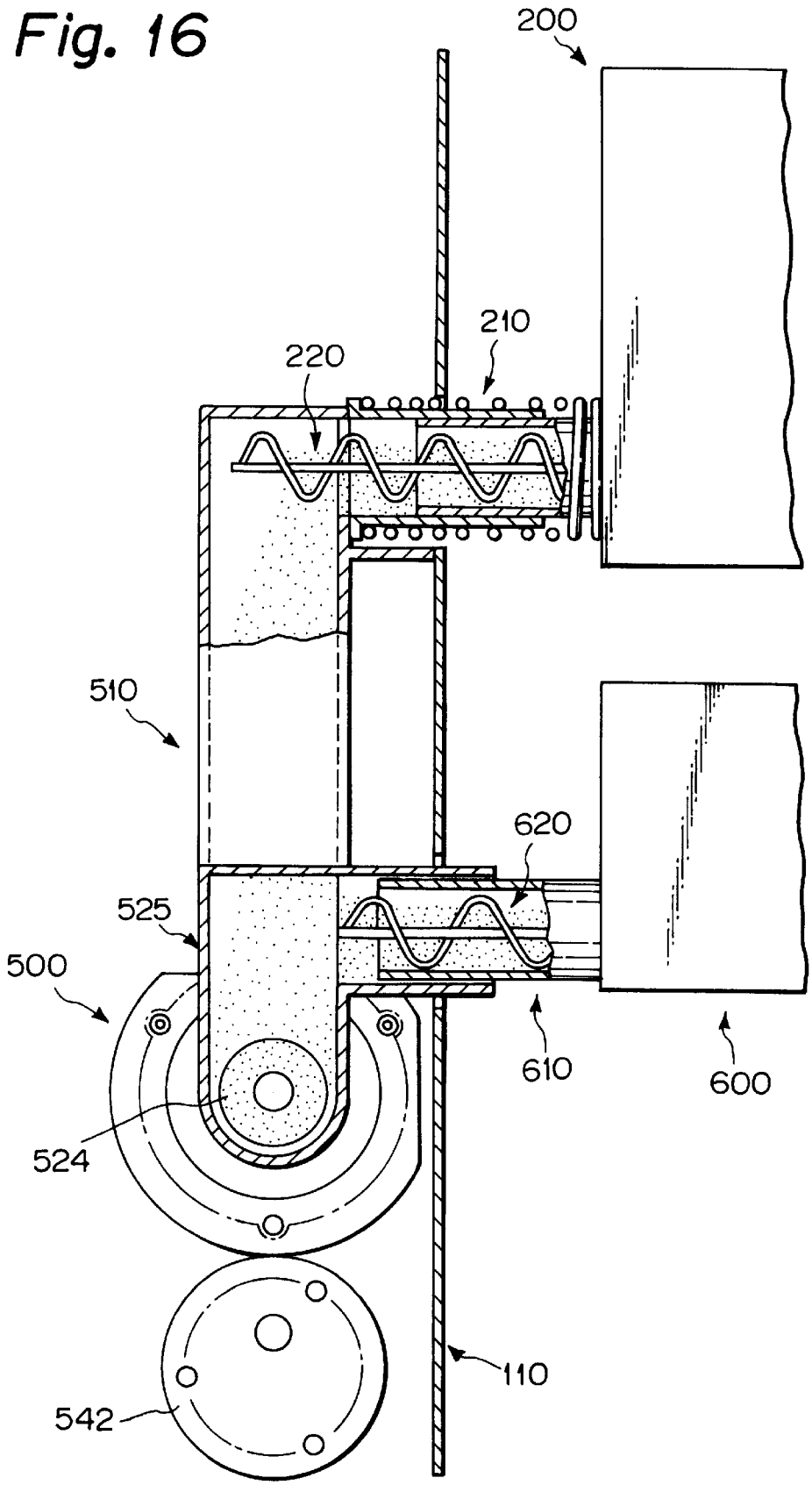
FIG. 16 is a fragmentary section also showing the toner conveying unit shown in FIG. 14.

FIG. 16 shows a part of the above toner conveying unit 500. As shown, the toner outlet portion 210 of the cleaning unit 200 is engaged with the toner guiding member 510 forming part of the toner conveying unit 500. The toner discharging member 220 disposed in the toner outlet portion 210 and implemented as, e.g., a coil screw conveys the toner from the cleaning unit 200 to the toner guiding member 510. Likewise, the toner outlet portion 610 of the transfer belt unit 600 is engaged with the toner guiding member 510. A toner discharging member 620 is disposed in the toner outlet portion 610 and implemented as a coil screw. The coil screw 620 conveys the toner from the transfer belt unit 600 to the toner guiding member 510.

In the configuration shown in FIGS. 14–16, the rotor 521 of the powder pump 520 and the screw 524 are driven by the exclusive motor 542. Alternatively, the pump 520 may be connected to the drive system included in the copier body for the purposes stated earlier.

Now, the problem with the toner for use in an electrophotographic image forming apparatus is that it has low fluidity and cannot be easily conveyed. In addition, paper dust and other impurities contained in the collected toner aggravate the fluidity of the toner. Generally, it is not desirable to subject the collected toner to heavy mechanical stresses during conveyance. Heavy stresses not only bring about the blocking and pulverization of the toner which would make the conveyance practically impossible, but also damage a coil, screw, piping and other conveying members as well as drive members. It is therefore important to free the collected toner from excessive mechanical stresses as far as possible during conveyance.

It has been customary with wan image forming apparatus to convey the collected toner by use of a screw and a piping, as discussed earlier. The mechanical stress ascribable to the screw and the mechanical stress ascribable to friction acting between the screw and the piping are extremely heavy. Such stresses increase with an increase in the distance of conveyance and in the change in the direction of conveyance. Of course, the torque necessary for the screw to be driven increases. Under these circumstances, the distance of conveyance cannot be increased or the direction of conveyance cannot be changed unless a plurality of screws and a plurality of pipings are operatively connected together. This increases the number of parts and cost, lowers reliability and productivity, obstructs easy maintenance, and increases the size of the apparatus body and the area to be occupied thereby due to an increase in the size of the toner collecting device.

Moreover, the toner collected by cleaning means assigned to a photoconductive element and an intermediate image transfer body, respectively, contain only a relatively small amount of impurities and can be returned to a developing unit. However, the conventional apparatus cannot reuse the collected toner because the toner is damaged due to the defects of the toner conveying device.

In accordance with the present invention, the collected toner is conveyed together with air via the tubing 400. This minimizes mechanical stresses to act on the toner being conveyed and eliminates a drive load in the tubing 400. The present invention therefore surely conveys the collected toner and obviates limitations regarding the distance and direction of conveyance. Consequently, reliable and durable toner conveyance is insured while the construction is simplified, reducing the drive load and therefore power consumption and running cost.

The toner conveying unit 500 is communicated to the tank or toner storing means 300 only by the flexible tubing 400. This allows the unit 500 to be constructed as a miniature unit independent of the apparatus body and thereby reduces limitations regarding the mounting of the unit 500 to the apparatus body. Hence, the limited space available in the apparatus body is efficiently used, and the high productivity and easy maintenance of the apparatus body and toner conveying unit 500 are noticeably enhanced.

Further, the collected toner free from damage can be recirculated to the developing unit and reused. Particularly, as for the cleaning means for cleaning the drum and intermediate transfer body, respectively, the tubing may be connected to the developing unit so as to reuse the collected toner because the toner collected by such cleaning means contains only a small amount of impurities. This reduces the copy cost to a considerable degree, further simplifies the apparatus body, and miniaturizes the apparatus body while reducing the running cost.

Various modifications will become possible for those skilled in the art after receiving the teachings of the present disclosure without departing from the scope thereof. For example, while the cleaning unit 200 is shown and described as using a blade, it may, of course, use a magnet brush cleaning scheme or a fur brush cleaning scheme by way of example.

What is claimed is:

1. An image forming apparatus comprising:

a cleaning device for removing toner remaining after image formation;

a developing device for developing a latent image electrostatically formed on an image carrier to thereby produce a corresponding toner image;

a toner storing device for storing the toner collected by said cleaning device;

a toner conveying device for conveying the toner collected by said cleaning device to at least one of said developing device and said toner storing device; and screw pump means included in said toner conveying device, for rotating a rotor to thereby move the toner collected by said cleaning device from said cleaning device in the axial direction of said rotor.

2. An apparatus as claimed in claim 1, wherein said toner conveying device comprises air feeding means for feeding air under pressure for dispersing the toner being moved by said screw pump means.

3. An apparatus as claimed in claim 2, further comprising air sensing means positioned between said screw pump means and said air feeding means, for determining whether or not air under pressure is being fed from said air feeding means to said screw pump means.

4. An apparatus as claimed in claim 3, further comprising a controller for causing said screw pump means and a body of said apparatus to stop operating when an output of said air sensing means shows that air under pressure is not fed from said air feeding means to said screw pump means.

5. An apparatus as claimed in claim 4, wherein said screw pump means and said cleaning means are constructed integrally with each other.

6. An apparatus as claimed in claim 5, wherein said toner conveying device comprises toner moving means constructed integrally with said cleaning means for moving the toner collected by said cleaning means, and wherein said rotor of said screw pump means is rotatable in engagement with said toner moving means.

7. An apparatus as claimed in claim 4, wherein said screw pump means is constructed independently of said cleaning means.

8. An apparatus as claimed in claim 3, wherein said screw pump means is constructed integrally with said cleaning means.

9. An apparatus as claimed in claim 8, wherein said toner conveying device comprises toner moving means constructed integrally with said cleaning means for moving the toner collected by said cleaning means, and wherein said rotor of said screw pump means is rotatable in engagement with said toner moving means.

10. An apparatus as claimed in claim 3, wherein said screw pump means is constructed independently of said cleaning means.

11. An apparatus as claimed in claim 3, further comprising connecting means positioned between said cleaning means and at least one of said developing means and said toner storing means, for communicating and separably connecting said air feeding means and a toner guiding means.

12. An apparatus as claimed in claim 2, wherein said screw pump means is constructed integrally with said cleaning means.

13. An apparatus as claimed in claim 12, wherein said toner conveying device comprises toner moving means constructed integrally with said cleaning means for moving the toner collected by said cleaning means, and wherein said rotor of said screw pump means is rotatable in engagement with said toner moving means.

14. An apparatus as claimed in claim 2, wherein said toner conveying means comprises toner guiding means for guiding the toner collected by said cleaning means and being moved by said screw pump means to at least one of said developing means and said toner storing means.

15. An apparatus as claimed in claim 14, wherein said toner guiding means comprises a flexible tubing.

16. An apparatus as claimed in claim 14, further comprising connecting means positioned between said cleaning means and at least one of said developing means and said toner storing means, for communicating and separably connecting said air feeding means and said toner guiding means.

17. An apparatus as claimed in claim 2, further comprising connecting means positioned between said cleaning means and at least one of said developing means and said toner storing means, for communicating and separably connecting said air feeding means and a toner guiding means.

18. An apparatus as claimed in claim 2, wherein said toner conveying means comprises toner guiding means for guiding the toner collected by said cleaning means and being moved by said screw pump means to at least one of said developing means and said toner storing means.

19. An apparatus as claimed in claim 18, wherein said toner guiding means comprises a flexible tubing.

20. An apparatus as claimed in claim 18, further comprising connecting means positioned between said cleaning means and at least one of said developing means and said toner storing means, for communicating and separably connecting said air feeding means and said toner guiding means.

21. An apparatus as claimed in claim 2, wherein said cleaning means removes the toner remaining on a photoconductive drum, intermediate image transfer body or similar image forming member.

22. An apparatus as claimed in claim 2, wherein said cleaning means removes the toner remaining on a transfer belt or similar sheet conveying member.

23. An apparatus as claimed in claim 2, wherein a plurality of cleaning means are provided, and wherein said toner conveying device conveys the toner collected by said plurality of cleaning means to at least one of said developing means and said toner storing means.

24. An apparatus as claimed in claim 23, further comprising toner moving means for moving the toner collected by said cleaning means to said screw pump means, wherein said toner moving means comprises a screw substantially coaxially connected to said rotor of said screw pump means, and a guide member for guiding the toner collected by said plurality of cleaning means to said toner conveying device, and wherein said guide member comprises a tubing for causing the toner output from said plurality of cleaning means to drop onto said screw by gravity.

25. An apparatus as claimed in claim 23, wherein said plurality of cleaning means comprises cleaning means for removing the toner from a photoconductive element, intermediate transfer body or similar image forming member, and cleaning means for removing the toner from a transfer belt or similar sheet conveying member.

26. An apparatus as claimed in claim 2, wherein said screw pump means is constructed independently of said cleaning means.

27. An apparatus as claimed in claim 1, wherein said screw pump means is constructed independently of said cleaning means.

28. An apparatus as claimed in claim 1, wherein said screw pump means is constructed integrally with said cleaning means.

29. An apparatus as claimed in claim 28, wherein said toner conveying device comprises toner moving means constructed integrally with said cleaning means for moving the toner collected by said cleaning means, and wherein said rotor of said screw pump means is rotatable in engagement with said toner moving means.

30. An image forming apparatus comprising:

a cleaning device for removing toner remaining after image formation;

a developing device for developing a latent image electrostatically formed on an image carrier to thereby produce a corresponding toner image;

a toner conveying device for conveying the toner collected by said cleaning device to said developing device; and screw pump means included in said toner conveying device, for rotating a rotor to thereby move the toner collected by said cleaning device from said cleaning device in the axial direction of said rotor.

31. An apparatus as claimed in claim 30, wherein said toner conveying device comprises air feeding means for feeding air under pressure for dispersing the toner being moved by said screw pump means.

* * * * *